US005261320A

United States Patent [19]

Niederstadt et al.

[11] Patent Number: 5,261,320

[45] Date of Patent: Nov. 16, 1993

[54] PNEUMATIC ROTARY DRIVE

[75] Inventors: Jörg Niederstadt, Schramberg; Ralf Huber, Brigachtal, both of Fed. Rep. of Germany

[73] Assignee: Mannesmann Aktiengesellschaft, Dusseldorf, Fed. Rep. of Germany

[21] Appl. No.: 994,419

[22] Filed: Dec. 21, 1992

[30] Foreign Application Priority Data

Dec. 20, 1991 [DE] Fed. Rep. of Germany ..... 4142846

[51] Int. Cl.[5] ..... F01B 19/00

[52] U.S. Cl. ..... 92/90; 92/137; 92/120

[58] Field of Search ..... 92/89, 90, 137, 120; 418/45

[56] References Cited

U.S. PATENT DOCUMENTS

| | | | |
|---|---|---|---|
| 3,417,942 | 12/1968 | Van Alstyne | 92/90 |
| 4,616,556 | 10/1986 | Meilman et al. | 92/90 |
| 4,756,237 | 7/1988 | Shishkin et al. | 92/90 |
| 4,838,148 | 6/1989 | Denker | 92/90 |
| 4,876,946 | 10/1989 | Shishkin et al. | 92/90 |

FOREIGN PATENT DOCUMENTS

| | | | |
|---|---|---|---|
| 2351990 | 10/1973 | Fed. Rep. of Germany | 92/90 |
| 0937801 | 6/1982 | U.S.S.R. | 92/90 |

*Primary Examiner*—Thomas E. Denion

*Attorney, Agent, or Firm*—Cohen, Pontani, Lieberman, Pavane

[57] ABSTRACT

A pneumatic rotary drive includes a housing and at least one cover sealingly closing the housing. A rotatable shaft extends out of the housing through the at least one cover. At least one guide member is mounted in the housing. A belt mounted in the housing is in engagement with the shaft. A pressing member presses two portions of the belt together so that two expandable pressure chambers are formed. When pressure is admitted to one of the pressure chambers, the pressure chamber expands and the shaft is rotated. The belt has two ends which are located adjacent each other in a common plane and form one of the belt portions which are pressed together. The housing has an internal wall with a toothing which is in engagement with an external toothing of the belt.

2 Claims, 1 Drawing Sheet

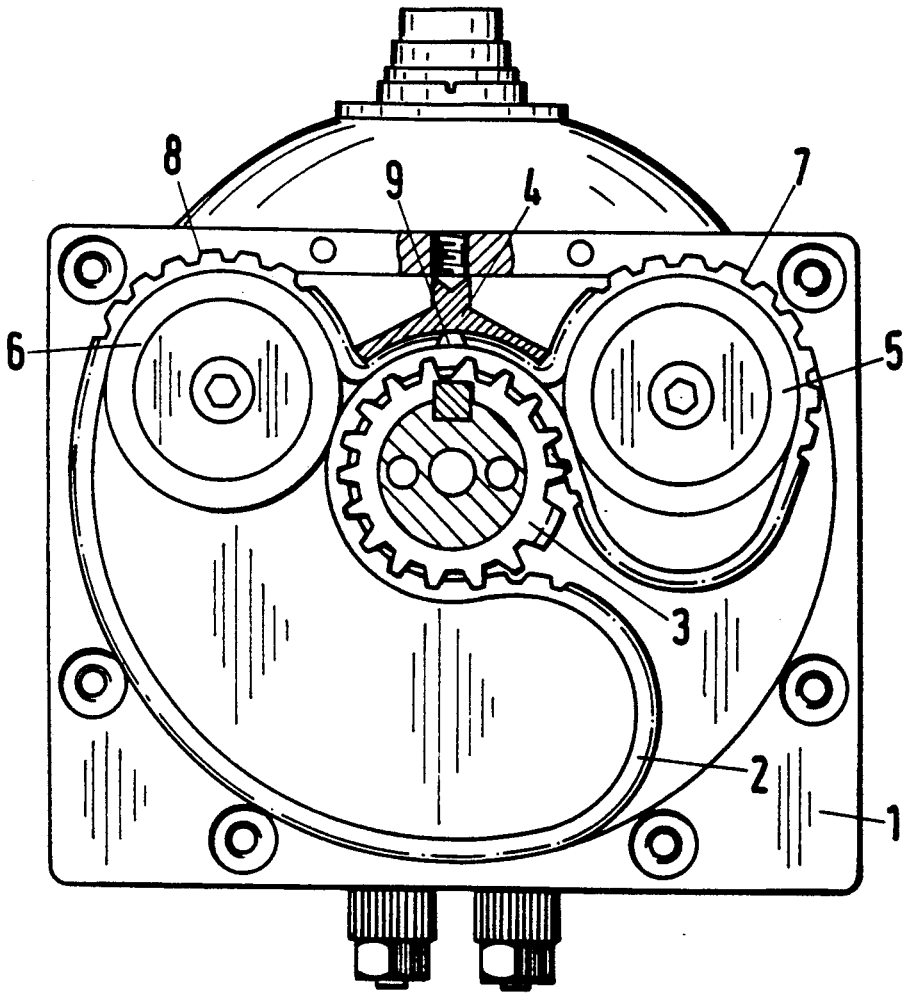
8
9
4
7
6
5
3
2
1

PNEUMATIC ROTARY DRIVE

BACKGROUND OF THE INVENTION

1. Field of the Invention

The present invention relates to a pneumatic rotary drive.

2. Description of the Related Art

U.S. Pat. No. 4,838,148 discloses a pneumatic rotary drive in which a shaft and a guide body are arranged within a housing. The guide body is completely surrounded by a ring-shaped closed belt which has an external toothing and engages the shaft which is provided with a complimentary toothing. The ring-shaped belt is placed around the guide body in such a way that the belt defines a kidney-shaped contour. This kidney-shaped contour forms pressure medium chambers. Depending on which side the pressure medium is applied, the ring-shaped belt travels to the one side or the other side until a belt portion rests against one or the other side of the guide body and cannot yield any further. The movement carried out between these end stop positions can be transmitted through the toothings of belt and shaft to the shaft itself, so that a rotary movement of the shaft is produced which can be picked off on the outside. In the ideal case, when the appropriate pressure is applied, the belt should not slide, but rather the kidney shape should unwind in a rolling manner.

However, in the rotary drive known from the above-mentioned U.S. Patent, it may occur that the belt slides through in the region of the portion which rests against the inner wall when pressure is applied and, thus, effectively a smaller unrolling distance of the kidney-shaped belt is available. Consequently, because of the resulting smaller unrolling distance of the kidney contour, effectively also a smaller angle of rotation is available for picking off on the outside. Moreover, there is the disadvantage that, because of the possibility of yielding of the belt, the force which can be applied to the rotary shaft is limited by static friction or, in the most unfavorable case, by sliding friction which is even smaller.

U.S. patent application Ser. No. 07/861,228 proposes a rotary drive of the above-described type which is provided with two guide bodies which are spaced apart from each other and rest with the belt against the outer circumference of the shaft. In this rotary drive, as is the case in the rotary drive known from the above-mentioned U.S. patent, the belt itself is a ring-shaped closed belt. Such a ring-shaped closed belt has the disadvantage that it is relatively complicated to manufacture because it must be manufactured either as a whole by injection molding or, if the belt is to be made from a strip of material, the ends of the belt have to be glued together subsequently in a complicated manner. As a result, the belt and, thus, the rotary drive is complicated and expensive to manufacture.

SUMMARY OF THE INVENTION

Therefore, it is the object of the present invention to provide a belt which is less expensive to manufacture and simultaneously to propose a rotary drive in which the tensile force acting on the belt is reduced by inexpensive means, and additionally to ensure a secure guidance of the belt and, thus, to make available great forces which can be picked off at the shaft.

In accordance with the present invention, the pneumatic rotary drive of the above-described type includes a housing which is closed in a pressure medium-tight manner by means of a cover and at least one shaft extending through the cover out of the housing. A belt surrounds at least one guide body arranged within the housing and forms two movable pressure medium chambers. An adjustable pressing member serves to press together two belt portions which extend over a part of its length in order to separate the pressure medium chambers from each other in a pressure medium-tight manner. The belt is composed of a strip portion of defined length whose two ends are held in the same plane and adjacent each other by means of the pressing member. The housing has an inner wall which is provided with a toothing which complements a toothing provided on the belt, wherein the toothing on the inner wall extends along the length of the belt which remains stationary when the belt imparts a rotary movement on the shaft.

In accordance with an advantageous feature of the present invention, the toothing of the inner wall of the housing which complements the toothing of the belt is arranged adjacent the guide bodies.

The present invention deals with the problem that when the belt is divided in the above-described manner, so that the belt is composed of a belt strip of defined length, while the belt can be manufactured inexpensively and obtained simply "from a roll, there is the necessity of securing the ends of the belt as well as the belt itself in such a way that the ends of the belt strip cannot move apart from each other in such a way that the belt ends are completely ripped out of their anchorings when high pressures are applied.

The present invention solves this problem by the feature according to which the housing is provided on its inner wall with a toothing which is complementary to the toothing of the belt, wherein the toothing of the inner wall is provided along a length of the belt which remains stationary during unrolling of the kidney-shaped portion of the belt and rotation of the shaft. In other words, the belt is held stationary over a portion of its length, so that the belt ends cannot be ripped out of their anchorings which, in this case, are in the area of the pressing member. Accordingly, the tensile load acting on the belt in the areas near the ends of the belt is reduced.

By utilizing a belt which is composed of a belt strip of defined length, together with the internal toothing on the inner wall of the housing, the present invention meets the above-described object because in the rotary drive it is no longer necessary to provide a belt which is previously manufactured in a ring-shaped closed form, but rather the belt can be obtained essentially "from the roll".

With respect to the problems described above in connection with the prior art, particularly in a rotary drive of the type described in the above-mentioned patent, the partial internal toothing of the housing which engages in a complementary manner in the toothing of the belt in accordance with the present invention additionally ensures an optimum rolling of the belt and, consequently, a highly efficient force transmission.

If the present invention is utilized in a rotary drive of the type described in above-mentioned U.S. patent application Ser. No. 07/861,228, it is a particularly useful feature that the complementary toothing is provided on the inner wall of the housing in the areas near the guide body or guide bodies. Also in this case, the tensile forces acting on the belt are reduced in the portions near the belt ends, so that the belt ends cannot be ripped out of their anchorings. Moreover, whether the invention is used in a rotary drive of the type described in U.S. Pat. No. 4,838,148 or in a rotary drive as described in the above-mentioned U.S. Patent Application, an optimum rolling of the belt along the inner wall of the housing is ensured, so that an efficient force transmission between belt and shaft is obtained.

When the invention is used in a rotary drive of the type described in the above-mentioned U.S. Patent, the belt has to be divided, or the belt ends have to be arranged where the guide body contacts the inner wall of the housing through the belt. In accordance with the features of the present invention, the inner wall of the housing would have to be provided with a toothing in this region, i.e., adjacent the guide body. As in the rotary drive of the type described in the above-mentioned U.S. Patent Application, a pressing member has to be provided which presses the belt against the guide body to effect additional support and sealing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWING

In the Drawing:

The single FIG. of the drawing is a schematic sectional view of a rotary drive according to the present invention.

DESCRIPTION OF THE PREFERRED EMBODIMENT

The drawing schematically illustrates a pneumatic rotary drive generally of the type which is disclosed in U.S. patent application Ser. No. 07/861,228 and in which the present invention is used.

The pneumatic rotary drive includes a shaft 3 which extends outwardly through at least one of the housing covers, not shown, of a housing 1 of the drive. Two guide bodies 5, 6 are mounted in the housing 1. The guide bodies 5, 6 are spaced apart from each other and the outer peripheries thereof rest against the outer periphery of the shaft 3 through a belt 2.

As is apparent from the drawing, the belt 2 no longer is composed of a ring-shaped closed belt. Rather, the belt is a belt strip of defined length. The two ends of the belt are mounted so as to extend essentially in a plane and the ends are spaced apart from each other by a small gap 9. A pressing member 4 presses the belt ends against a belt portion which slides along underneath the belt ends. The pressing member 4 serves to support the belt ends, on the one hand, and to seal from each other the two pressure chambers formed by the belt on the lift side and the right side, as seen in the drawing. The guide bodies 5, 6 are cylindrical and, as also illustrated in the drawing, have a circular cross-section. However, the guide bodies 5, 6 are preferably not rotatable, but are mounted stationary in the housing 1.

The housing 1 has an inner wall within which the belt 2 moves when pressure is applied to one of the pressure chambers. Adjacent the guide bodies 5, 6 the inner wall is provided with a toothing 7, 8 which complements the toothing of the belt 2. Accordingly, the toothing of the belt engages more or less positively in the toothing 7, 8 of the inner wall of the housing 1 and, consequently, is secured against slipping, sliding, etc. However, the belt 2 not only has an external toothing in this area, but has a toothing over most of its length along which it is in engagement with the shaft 3 and with the toothing 7, 8 of the inner wall of the housing. In the simplest case, the belt 2, which according to the present invention is obtainable directly "from a roll", is toothed over the entire length thereof.

In summary, the belt according to the present invention is manufactured from extremely inexpensive belt material which can be obtained "from a roll", i.e. from a material which is available rolled up on a roll. This means that the relatively complicated manufacture of the ring-shaped closed belt used in rotary drives of the prior art is unnecessary. In addition, because the strip material is taken from a roll, it is possible in a simple and inexpensive manner to use or introduce wire reinforcements in longitudinal direction of the belt for further securing the belt against tearing. As a result of the meshed engagement with the toothing of the inner wall of the housing, the belt is supported in any position thereof in a manner which reduces tensile forces, so that the belt or belt ends cannot loosen when high pressures are applied and/or when pressure is applied for a long time.

It should be understood that the preferred embodiments and examples described are for illustrative purposes only and are not to be construed as limiting the scope of the present invention which is properly delineated only in the appended claims.

What is claimed is:

1. A pneumatic rotary drive comprising a housing, at least one cover sealingly closing the housing in a pressure medium-tight manner, a rotatable shaft extending out of the housing through the at least one cover, at least one guide member mounted in the housing, a belt having an external toothing mounted in the housing in engagement with the shaft and extending around the at least one guide member, the belt having first and second length portions in contact with each other, such that the belt defines two expandable pressure chambers, a pressing member for pressing the first and second length portions together in a pressure medium-tight manner, means for admitting pressure medium to the pressure chambers, such that the belt is rotated when pressure medium is admitted to one of the pressure chambers so as to expand the pressure chamber, the belt having two ends, the two ends being mounted adjacent each other in a common plane, the two ends forming the first length portion being pressed by the pressure member against the second length portion, the housing having an inner wall, the inner wall having a toothing in engagement with the external toothing of the belt.

2. The pneumatic rotary drive according to claim 1, wherein the toothing of the inner wall of the housing is located adjacent the at least one guide member.

* * * * *